US009745780B2

(12) United States Patent
Chen

(10) Patent No.: US 9,745,780 B2
(45) Date of Patent: Aug. 29, 2017

(54) LOCK AND CASE USING THE SAME

(71) Applicant: SINOXLOCK (KUNSHAN) CO., LTD., Kunshan (CN)

(72) Inventor: Mao-Yi Chen, Kunshan (CN)

(73) Assignee: SINOXLOCK (KUNSHAN) CO., LTD., Kunshan (CN)

( * ) Notice: Subject to any disclaimer, the term of this patent is extended or adjusted under 35 U.S.C. 154(b) by 266 days.

(21) Appl. No.: 14/696,826

(22) Filed: Apr. 27, 2015

(65) Prior Publication Data

US 2015/0315820 A1 Nov. 5, 2015

(30) Foreign Application Priority Data

Apr. 30, 2014 (CN) ..... 2014 2 0217406 U

(51) Int. Cl.

| | |
|---|---|
| ***E05B 47/06*** | (2006.01) |
| ***E05B 65/52*** | (2006.01) |
| ***E05B 65/48*** | (2006.01) |
| ***E05B 47/00*** | (2006.01) |
| *A44B 19/30* | (2006.01) |

(52) U.S. Cl.

CPC ..... *E05B 65/52* (2013.01); *E05B 47/0001* (2013.01); *E05B 47/0603* (2013.01); *E05B 65/48* (2013.01); *A44B 19/301* (2013.01); *E05B 2047/0056* (2013.01); *E05B 2047/0094* (2013.01); *Y10T 70/508* (2015.04); *Y10T 70/7486* (2015.04)

(58) Field of Classification Search

CPC ... A44B 19/301; E05B 65/52; E05B 47/0603; E05B 47/0001; E05B 65/48; E05B 2047/0094; E05B 2047/0056; E05B 47/0607; Y10T 70/7486; Y10T 70/508; Y10T 70/5053; Y10T 70/7107

USPC ..... 70/21, 68, 279.1, 284, 285, 257, 277, 70/278.3, 278.7, 283.1

See application file for complete search history.

(56) References Cited

U.S. PATENT DOCUMENTS 4,570,466 A * 2/1986 Matthews ..... E05B 47/0002 292/150
4,714,030 A * 12/1987 Cole ..... G07C 9/0069 109/59 T
4,774,512 A * 9/1988 Jolidon ..... G07C 9/00674 340/11.1
4,909,053 A * 3/1990 Zipf, III ..... E05B 47/0623 292/144

(Continued)

*Primary Examiner* — Lloyd Gall

(74) *Attorney, Agent, or Firm* — Innovation Capital Law Group, LLP; Vic Lin

(57) ABSTRACT

The lock of the present invention includes a housing, a fastening element, a stopping element, a first locking mechanism and a second locking mechanism. The fastening element is movable relative to the housing and is selectively located at a securing position and a releasing position; the stopping element has a first state and a second state. The stopping element in the first state restricts the fastening element to be in the securing position while the stopping element in the second state releases the fastening element. The first locking mechanism includes a dynamic element and a sensing device. The dynamic element drives the stopping element to change between the first state and the second state. The sensing device senses a signal and controls the dynamic element.

20 Claims, 10 Drawing Sheets

(56) References Cited

U.S. PATENT DOCUMENTS 4,936,122 A * 6/1990 Osada ..... E05B 47/0673 70/214
5,309,743 A * 5/1994 Kokubu ..... G07C 9/00309 307/10.1
5,487,289 A * 1/1996 Otto, III ..... E05B 47/0002 292/150
5,495,733 A * 3/1996 Yen ..... E05B 35/12 70/278.3
5,541,581 A * 7/1996 Trent ..... E05B 47/0673 340/5.55
5,557,954 A * 9/1996 Ling ..... E05B 37/12 70/312
5,701,770 A * 12/1997 Cook ..... E05B 47/02 206/1.5
6,568,225 B1 * 5/2003 Chang ..... E05B 37/12 70/333 R
6,705,136 B2 * 3/2004 Porter ..... E05B 47/0002 109/59 R
6,807,832 B1 * 10/2004 Jeng ..... E05B 37/12 190/101
7,178,370 B2 * 2/2007 Engel ..... F41A 17/066 109/50
7,415,853 B2 * 8/2008 Yu ..... E05B 37/02 70/21
7,424,814 B2 * 9/2008 Jasper ..... E05B 47/0607 292/92
8,096,150 B2 * 1/2012 Lai ..... A44B 19/301 70/21
8,161,778 B1 * 4/2012 Ma ..... E05B 35/007 70/21
8,307,518 B2 * 11/2012 Cheung ..... A44B 19/301 24/386
8,375,752 B2 * 2/2013 Chang ..... E05B 37/0031 70/162
8,511,121 B2 * 8/2013 Tsuruta ..... B60R 25/24 340/5.72
8,661,861 B2 * 3/2014 Lai ..... E05B 37/12 70/21
2004/0237605 A1 * 12/2004 Lin ..... A44B 19/301 70/68
2005/0072196 A1 * 4/2005 Ling ..... E05B 37/0034 70/284
2006/0032418 A1 * 2/2006 Smith ..... E05B 47/0603 109/59 R
2007/0132551 A1 * 6/2007 Mozer ..... E05B 47/0009 340/5.52
2008/0236212 A1 * 10/2008 Ma ..... E05B 37/0034 70/77
2012/0291503 A1 * 11/2012 Yang ..... E05B 5/00 70/284
2015/0014109 A1 * 1/2015 Lai ..... A45C 5/14 190/111
2015/0330104 A1 * 11/2015 Lai ..... E05B 37/12 70/285

* cited by examiner

LOCK AND CASE USING THE SAME

BACKGROUND OF THE INVENTION

1. Field of the Invention

The present invention generally relates to a lock. Specifically, the present invention relates to an electric lock.

2. Description of the Prior Art

Diverse locks nowadays are provided and meet different uses and conditions; however, these locks can be generally divided into two categories: mechanical locks and electric locks. The mechanical locks include key locks and combination locks. The electric locks may also be operated by means of key or cypher to proceed the unlock or lock operation. However, the electric lock may further cooperate with other facilities such as sensing, reading, and/or recognition devices so as to provide diverse unlocking, locking or supervising functions.

The media of operating the unlock and lock operation may be different based on the use of the electric lock. For example, possessing a proximity card or a key or knowing the cypher is the possible way to operate the electric lock. When unlocking and locking operations depend upon recognition of biological characteristic, only the specific user(s) is able to perform the unlock or lock operation; in this case, circumstances such as loss of the proximity card or the key or forgetting the cypher which results in inability of unlocking will not happen. Accordingly, the inventor designs a lock and a case which uses the lock, wherein the lock is suitable for a case and has simple unlocking and locking operations.

SUMMARY OF THE INVENTION

It is an object of the present invention to provide a lock which provides simple unlocking and locking operations.

It is another object of the present invention to provide a lock which is shockproof and suitable for transport facilities.

The lock of the present invention includes a housing, a fastening element, a stopping element, a first locking mechanism and a second locking mechanism. The fastening element is movable relative to the housing and selectively located at a securing position and a releasing position; the stopping element has a first state and a second state, wherein the stopping element in the first state restricts the fastening element to be in the securing position; the stopping element in the second state releases the fastening element. The first locking mechanism includes a dynamic element and a sensing device. The dynamic element drives the stopping element to change between the first state and the second state. The sensing device senses a signal and controls an action of the dynamic element.

The first locking mechanism of the lock of the present invention may alternatively include a sensing system electrically connected to the dynamic element; signal transmission and recognition in the sensing system controls the action of the dynamic element.

The lock of the present invention includes a second locking mechanism which includes a key-lock lock body disposed in the housing; wherein the fastening element, the stopping element and the dynamic element are disposed in the housing; the fastening element moves relative to the housing and is selectively located at the securing position and the releasing position.

In the lock mentioned above, the signal includes electromagnetic wave, image signal or biological characteristic signal.

The lock mentioned above further includes a power source connected to the sensing device.

In the lock mentioned above, the sensing device produces a sensing area outsides the housing; the signal enters the sensing area; the sensing device receives the signal and controls the action of the dynamic element.

In the lock mentioned above, the sensing device is a radio frequency identification element.

In the lock mentioned above, the radio frequency identification element is a reader; the reader acquires and recognizes a coded signal so as to activate the dynamic element.

In the lock mentioned above, the radio frequency identification element is a tag, wherein the tag carries a code for recognition.

In the lock mentioned above, the radio frequency identification element is powered and transmits a signal of the code.

In the lock mentioned above, the dynamic element is an electromagnetic valve; the electromagnetic valve has a driving shaft, wherein the sensing device controls the driving shaft to extend or retract.

In the lock mentioned above, the stopping element has an axial portion and a plurality of arm portions radiating from the axial portion.

In the lock mentioned above, the stopping element has a rotation axis and a first arm portion; the dynamic element has a driving shaft; the driving shaft extends and pushes the first arm portion to drive the stopping element to rotate.

In the lock mentioned above, the stopping element further has a second arm portion; the second arm portion in the first state contacts the fastening element and restricts the fastening element to be in the securing position; when the driving shaft drives the stopping element to rotate to the second state, the second arm portion releases the fastening element.

In the lock mentioned above, the fastening element includes a connecting arm and a latch disposed asides the connecting arm; one end of the connecting arm contacts the stopping element in the first state; the stopping element in the second state releases the fastening element, and the fastening element moves along the extension direction of the connecting arm to locate at the releasing position.

In the lock mentioned above, the housing further has a trough formed thereon and communicating with an interior of the housing, wherein the latch enters or leaves the trough; the latch stays in the trough when the fastening element is in the securing position.

The lock mentioned above further includes an operating device driving the fastening element to move.

In the lock mentioned above, the operating device is a press-button partially exposed and protruding out of the housing. The operating device is disposed at one end of the connecting arm opposite to the stopping element; the operating device is pressed and pushes the fastening element in the extension direction of the connecting arm.

In the lock mentioned above, the second locking mechanism further includes a driving portion; the driving portion is driven by a key and the key-lock lock body to change the state of the stopping element.

The lock of the present invention includes: a housing, a fastening element, a stopping element, a first locking mechanism, and a second locking element, wherein the fastening element is movable and selectively located at a securing position and a releasing position; the stopping element has a first state and a second state; the stopping element in the first state restricts the fastening element to be in the securing position; the stopping element in the second state releases the fastening element; the first locking mechanism includes a dynamic element and a sensing system; the dynamic element moves with the stopping element and drives the stopping element to change between the first state and the second state; the sensing system is electrically connected to the dynamic element; signal transmission and signal recognition in the sensing system controls the action of the dynamic element; the second locking mechanism includes a key-lock lock body and a driving portion disposed in the housing, wherein the driving portion is driven by a key and the key-lock lock body to change the state of the stopping element. The fastening element, the stopping element and the dynamic element are disposed in the housing; an outcome of the signal transmission and recognition is to activate the dynamic element; the fastening element moves relative to the housing and selectively located at the securing position and the releasing position.

In the lock mentioned above, the sensing system includes a sensing device and a transmitting device; the signal transmission occurs between the sensing device and the transmitting device, wherein the sensing device recognizes the signal.

In the lock mentioned above, the sensing system is a radio frequency identification system including a reader and a tag, wherein the tag carries a code for recognition.

In the lock mentioned above, the reader induces the tag to transmit a signal of the code; the reader acquires and recognizes the signal of the code to activate the dynamic element.

In the lock mentioned above, the reader induces the tag to produce electrical energy and activate the dynamic element.

The case of the present invention includes the above mentioned lock and a case body. The case body has a fastener for opening and closing the case body. The lock is disposed outsides the case body and on a body wall, wherein the housing has a trough formed thereon; the trough communicates with an interior of the housing and corresponds to the fastener. The latch of the fastening element of the lock enters or leaves the trough; the latch stays in the trough when the fastening element is in the securing position.

In the lock mentioned above, the fastener has a through hole and is accommodated in the trough; the latch in the securing position passes through the through hole and retains the fastener in the trough.

In the lock mentioned above, the latch has a guiding face; when the stopping element is in the second state, the fastener is capable of moving along the guiding face, pushes the latch to temporarily leave the securing position and is inserted in the trough; the latch goes back to the securing position and is retained in the trough.

In the lock mentioned above, the fastener is a zip fastener.

DETAILED DESCRIPTION OF THE PREFERRED EMBODIMENT

The lock of the present invention has the interior locking mechanism activated by signal induction to proceed to locking or unlocking actions. The induction may be contact or contactless inductions; the signal may be electromagnetic wave such as radio wave, visible light or ultrared induction, or image signal such as bar code reading, or recognition of biological characteristic such as fingerprint or iris, but not limited thereto.

Figure 1:
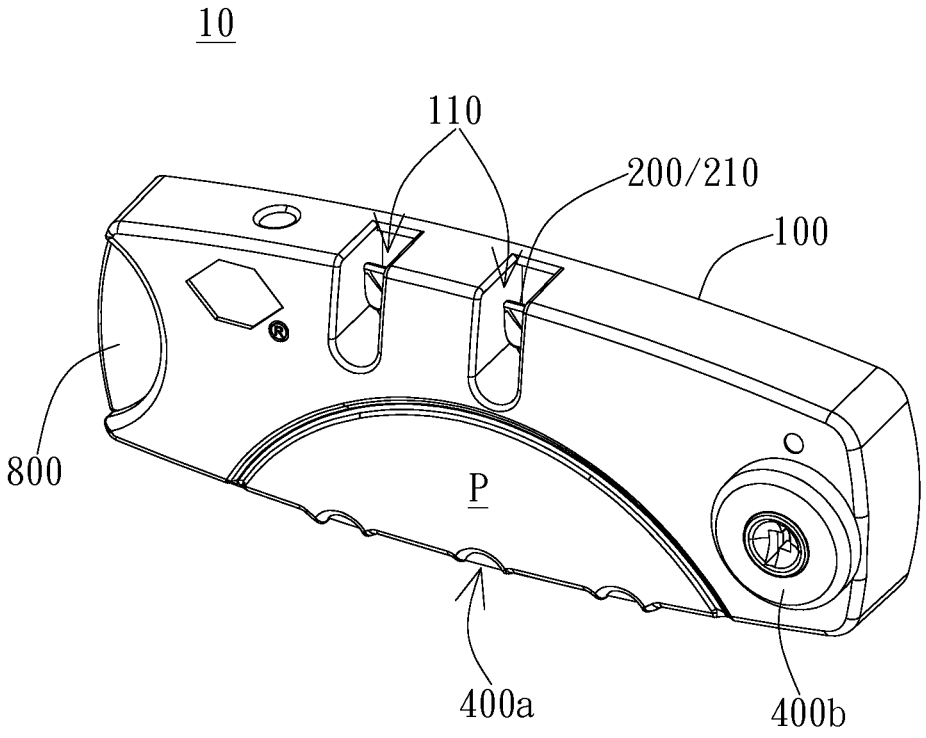
FIG. 1 is a perspective view of an embodiment of the lock of the present invention.
Figure 2A:
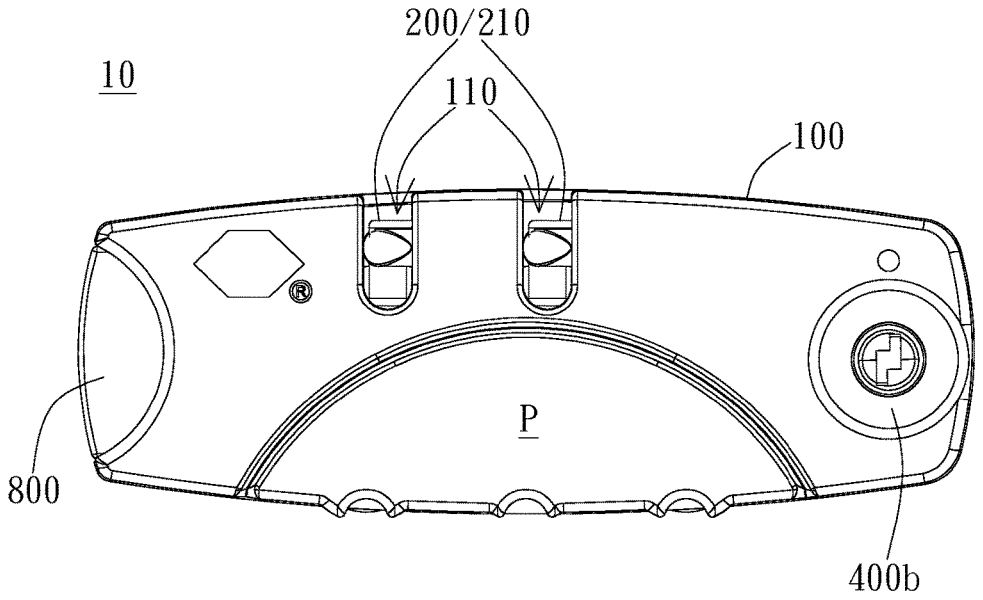
FIGS. 2A and 2B are top views of the embodiment of the lock of the present invention.
Figure 2B:
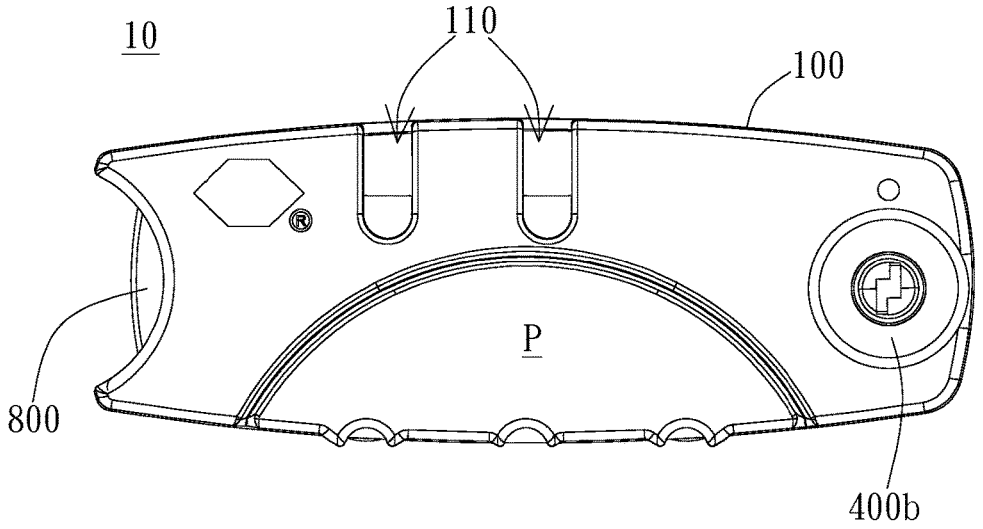

FIG. 1 and FIGS. 2A-2B show the appearance of the lock of the present invention. As shown in FIG. 1, the lock 10 includes a housing 100 and the fastening element 200, wherein the fastening element 200 is moveable and selectively located at a securing position shown in FIG. 2A or a releasing position shown in FIG. 2B. When the fastening element 200 is located at the securing position, an article to be secured can be connected to the lock 10 through the fastening element 200 so that the article is secured by the lock 10. On the other hand, the lock 10 has a sensing area P which covers an outside portion of the housing 100, wherein the lock 10 can sense the above mentioned signal which enters the sensing area P. For example, when radio wave enters the sensing area P which includes a coverage of an antenna, or the fingerprint is scanned by a fingerprint scanner, the lock 10 senses the radio wave or fingerprint and then has locking or unlocking of the interior locking mechanism activated.

In the present invention, a trough 110 is preferably formed on the housing 100 for connection of the article to be secured. For example, one side of the housing 100 has an indent as the trough 110, which communicates with the interior of the housing 100. The fastening element 200 is disposed in the housing 100 and has at least a portion capable of entering or leaving the trough 110 so as to interfere with the article to be secured. That is, when the fastening element 200 enters the trough 110 as shown in FIG. 2A, the fastening element 200 is in the securing position; when the fastening element 200 leaves away from the trough 110 as shown in FIG. 2B, the fastening element 200 is in the releasing position. When the fastening element 200 enters the trough 110, the fastening element 200 interferes with the article to be secured and further secures the same. In addition, when the lock 10 is in the unlocked status, the article to be secured preferably enters or leaves the trough 110 without a further unlocking operation.

Figure 3:
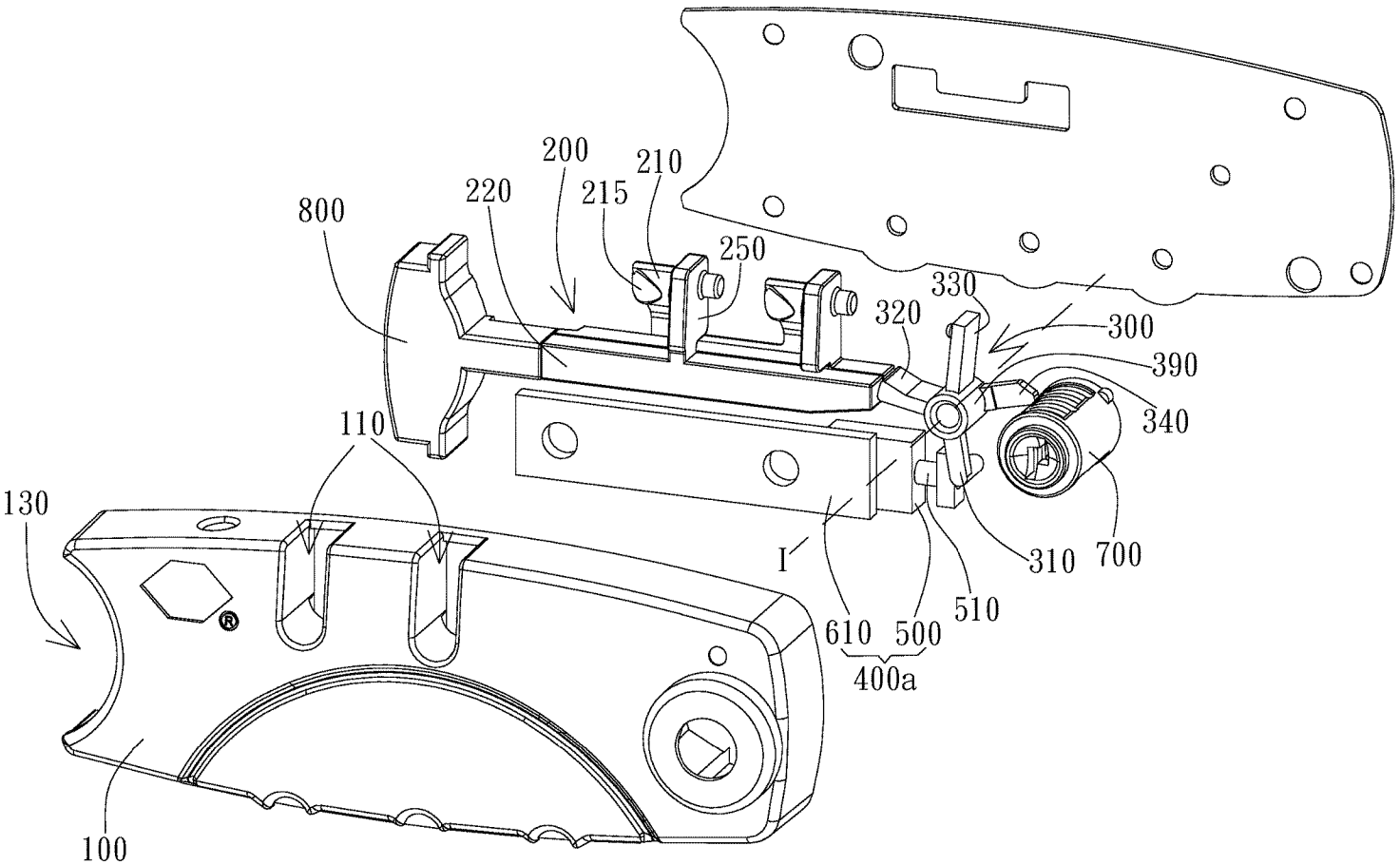
FIG. 3 and FIGS. 4A-4B are exploded views of the embodiment of the lock of the present invention.

As shown in FIG. 3, the lock 10 further includes a first locking mechanism 400*a*. A locked status of the first locking mechanism 400*a* restricts the fastening element 200 to be in the above mentioned securing position while an unlocked status of the first locking mechanism 400*a* releases the fastening element 200. The first locking mechanism 400*a* includes a sensing device 610 and a dynamic element 500. In addition, the lock 10 of the present invention further includes a stopping element 300 moving with the dynamic element 500, wherein it is preferred that the stopping element 300 substantially restricts the fastening element 200 to be in the securing position or releases the fastening element 200.

In detail, the sensing device 610 is electrically connected to the dynamic element 500. The sensing device 610 senses a signal and controls an action of the dynamic element 500 to accomplish the unlocking and/or locking action. The sensing device 610 preferably has the sensing area P which covers at least an outside portion of the housing 100. The sensing device 610 may include a sensing apparatus, a reading apparatus, a communicating apparatus or a combination thereof and is provided to acquire (and recognize) signal so as to control the dynamic element 500. For example, the sensing device 610 may include a fingerprint reader, a bar code reader, an ultrared sensor and/or a card reader. In addition, the lock 10 may further include a power source which is connected to the sensing device 610. A battery may serve as the power source to supply the necessary power for the lock 10.

Preferably, the sensing device 610 of the embodiment is a radio frequency identification element. Specifically, the radio frequency identification element is a reader; the reader acquires and recognizes a coded signal which enters the sensing area P so as to activate the dynamic element 500. The coded signal may be from portable devices such as a proximity card or a cell phone. That is, in comparison to possessing a key (for key lock) or memorizing an unlocking cypher (for combination lock), user here possesses the portable device such as the proximity card or the cell phone to unlock the lock 10.

In other embodiments, the radio frequency identification element may be a tag carrying a code for recognition. When the tag is powered, it transmits a signal of the code, wherein the tag may be induced by a reader and generate electrical energy so as to activate the dynamic element 500. On the other hand, the signal of the code may be acquired and recognized by such as the reader so as to activate the dynamic element 500. The reader here may be portable device which the user possesses to induce the lock.

The dynamic element 500 is disposed in the housing 100 and can be, for example, an electromagnetic valve or a motor. In the embodiment of the present invention, the dynamic element 500 is an electromagnetic valve having a driving shaft 510, wherein the sensing device 610 controls the driving shaft 510 to extend or retract. For example, when the radio frequency recognition element (i.e. the sensing device 610) acquires the coded signal and recognizes the coded signal as the correct, the radio frequency recognition element activates the driving shaft 510 of the electromagnetic valve to extend. In the present embodiment, the extension of the driving shaft 510 is related to the unlocking operation/action. The activation of the electromagnetic valve lasts for a predetermined period, the driving shaft 510 retracts after the predetermined period until next signal sensing/induction. In the present embodiment, the retraction of the driving shaft 510 is related to the locking operation/action. Alternatively, both extension and retraction of the driving shaft 510 may be activated through signal induction, i.e. the sending device 610 not only senses the signal and activates the driving shaft 510 to extend but also senses a signal/the signal and activates the driving shaft 510 to retract. The predetermined period may depend upon the reaction time of the electromagnetic valve and is related to the specifications for the electromagnetic valve. In addition, predetermined period may be designed based on an operation of the lock 10.

Figure 4A:
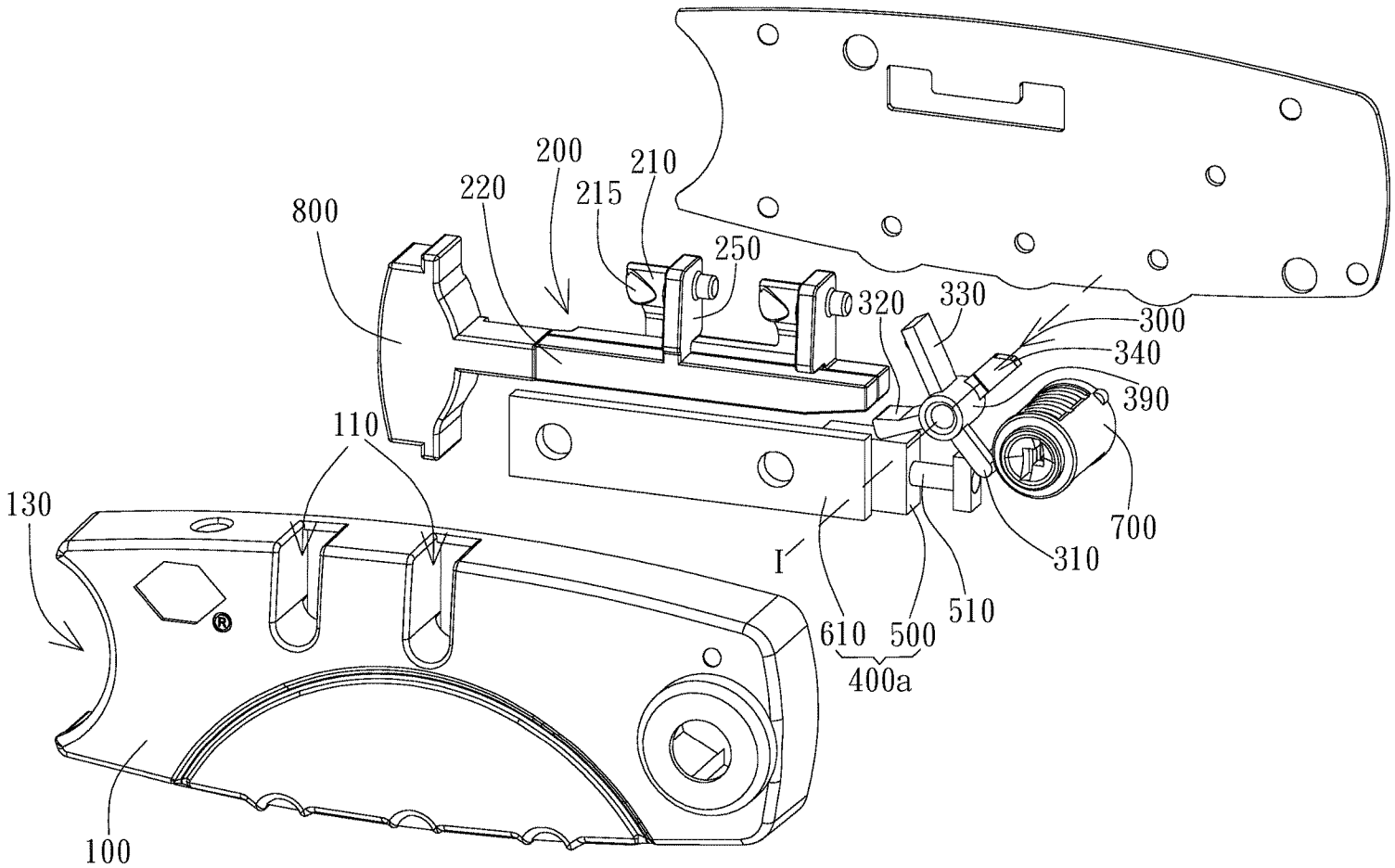
Figure 5:
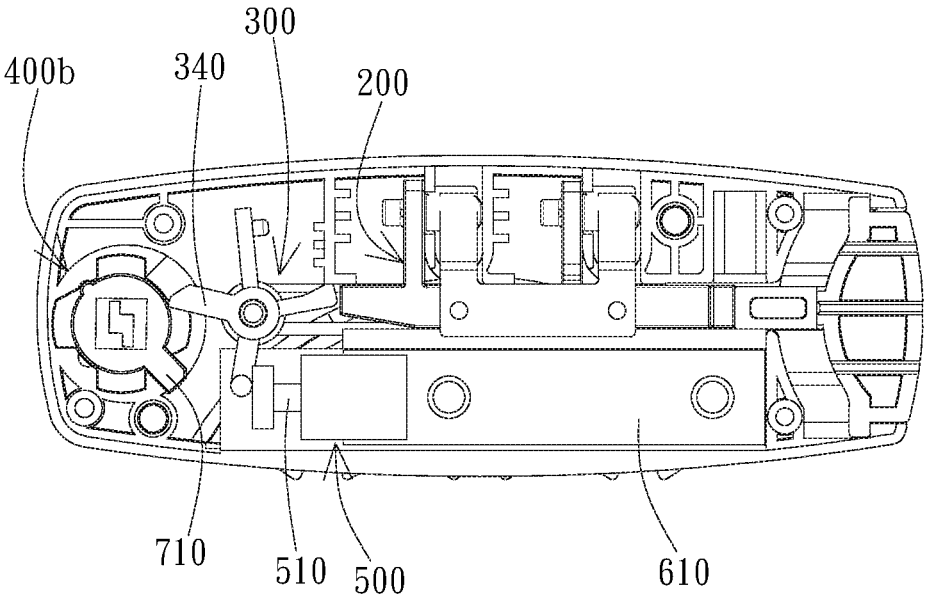
FIG. 5 and FIGS. 6A-6B are bottom views of the embodiment of the lock of the present invention which has a portion of the housing removed.
Figure 6A:
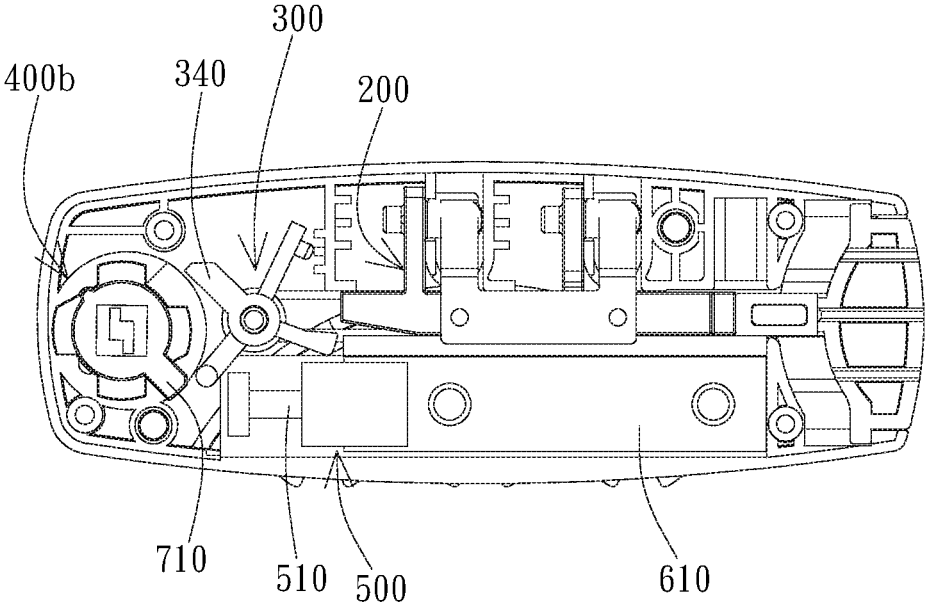

The action of the driving shaft 510 of the dynamic element 500 drives the stopping element 300 to change between the first state shown in FIGS. 3, 5 and the second state shown in such as FIGS. 4A, 6A, wherein the change of the stopping element 300 between the first state and the second state further restricts or releases the fastening element 200. As shown in FIGS. 3 and 5, the stopping element 300 of the embodiment is disposed substantially on a side of the driving shaft 510 corresponding to the extension direction of the driving shaft 510. In the general status, i.e. no signal sensing/induction, an end of the driving shaft 510 contacts the stopping element 300 as shown in FIGS. 3, 5. When the signal sensing/induction activates the action of the dynamic element 500, the driving shaft 510 extends and pushes the stopping element 300 as shown in FIGS. 4A and 6A. That is, as the sensing device 610 senses the signal, the sensing device 610 controls the action of dynamic element 500 in a manner that the driving shaft 510 extends to push the stopping element 300, resulting in the movement of the stopping element 300.

For example, the stopping element 300 has a first arm portion 310. The end of the driving shaft 510 contacts the first arm portion 310. The driving shaft 510 pushes the first arm portion 310 when extending as shown in FIGS. 3-4A and 5-6A. Preferably, the driving shaft 510 pushes the first arm portion 310 and drives the stopping element 300 to rotate by a rotation axis I. In addition, the stopping element 300 preferably further has a second arm portion 320. The second arm portion 320 also rotates along with the rotation of the stopping element 300. In addition, the second arm portion 320 contacts the fastening element 200 and restricts the fastening element 200 to be in the securing position or leave away from the fastening element 200 and releases the fastening element 200. In other words, when the stopping element 300 is in the first state as shown in FIGS. 3, 5, the stopping element 300 contacts the fastening element 200 through the second arm portion 320 and restricts the fastening element 200 to be in the securing position. When the stopping element 300 is in the second state as shown in FIGS. 4A, 6A, the second arm portion 320 of the stopping element 300 leaves away from the fastening element 200 and releases the same. The stopping element 300 is rotatable and changes between the first state and the second state.

In the preferred embodiment of the present invention, the stopping element 300 has an axial portion 390 and a plurality of arm portions radiating from the axial portion 390. The axial portion 390 may have a torsional member (not shown) disposed therein; the stopping element 300 has such as the first arm portion 310 and the second arm portion 320. The first arm portion 310 may be located in the extension direction of the driving shaft 510, wherein the end of the driving shaft 510 contacts the first arm portion 310. The second arm portion 320 is separated/angled away from the first arm portion 310 and an angle between the two arms is between 90 and 180 degree, wherein the second arm portion 320 in the first state contacts the fastening element 200. In addition, the end of the driving shaft 510 preferably contacts a side of the first arm portion 310, and the second arm portion 320 in the first state contacts the fastening element 200 by an end thereof away from the axial portion 390. When the driving shaft 510 extends and pushes the stopping element 300 to rotate, the second arm portion 320 rotates as well and the end thereof leaves away from the fastening element 200 so as to release the fastening element 200, as shown in FIGS. 3-4A and 5-6A. That is, when the driving shaft 510 of the driving element 500 is at the retraction state, the stopping element 300 is in the first state and the second arm portion 320 touches against the fastening element 200, so that the fastening element 200 is in the securing position and immovable. When the driving shaft 510 of the driving element 500 extends from the retraction state to the extension state, the driving shaft 510 extends to push the first arm 310 to rotate by the rotation axis I and the second arm portion 320 rotates along with the first arm portion 310 to leave the fastening element 200, so that the stopping element 300 is in the second state, and the fastening element 200 is released from the restriction of the second arm portion 320 to be movable. The torsional member may be turned and forced while the above rotation proceeds; accordingly, the torsional member may be capable as well of turning back and driving the stopping element 300 to rotate reversely. The stopping element 300 may further have a third, a fourth arm portions, etc. For example, the stopping element 300 may still have a third arm portion 330 separated/angled away from the second arm portion 320.

Figure 4B:
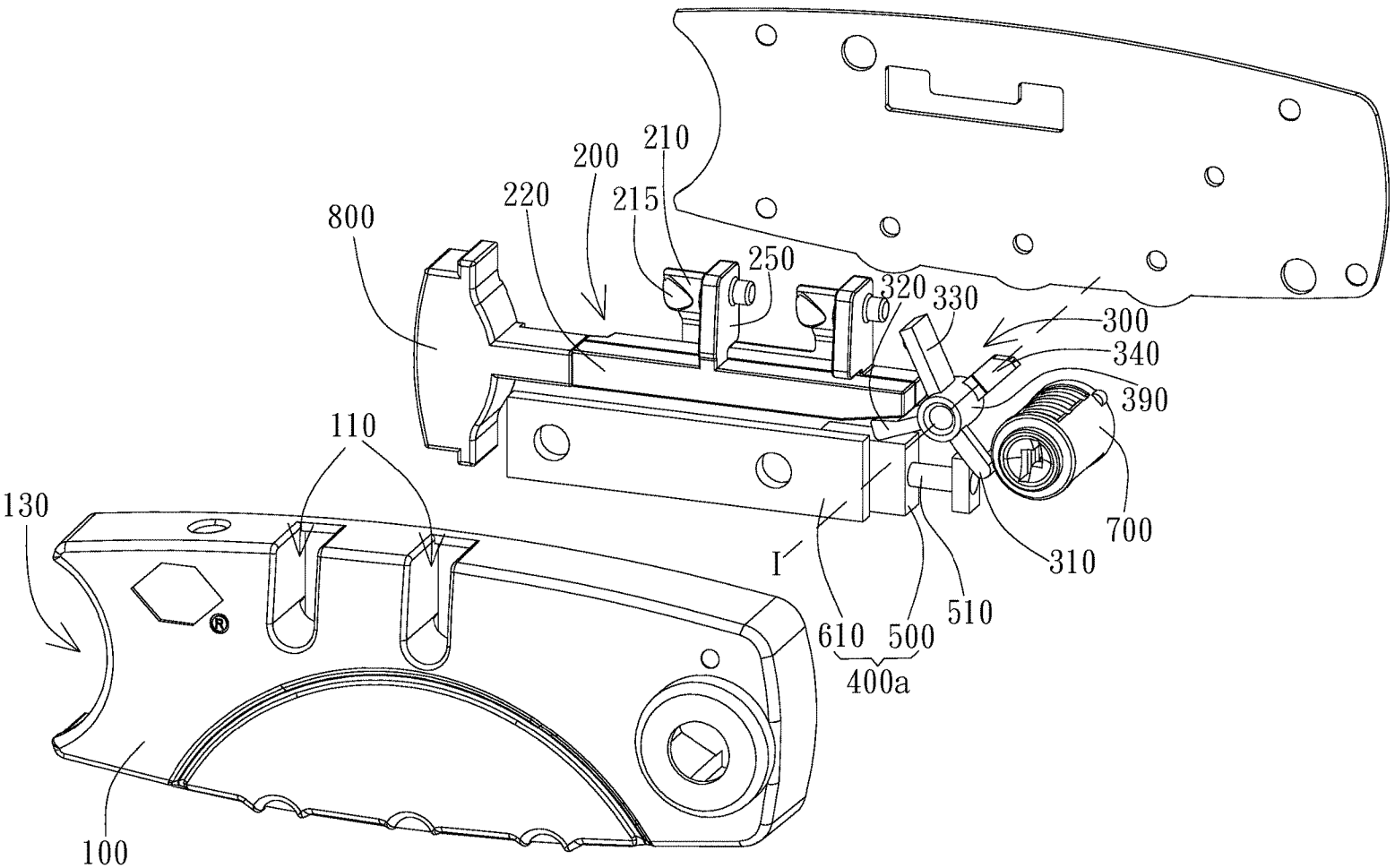
Figure 6B:
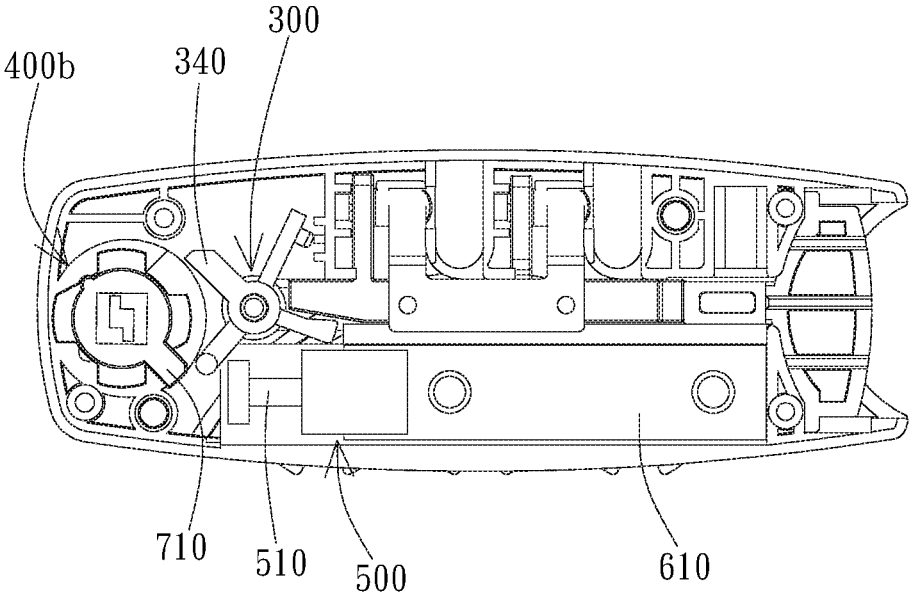

The fastening element 200 further includes a connecting arm 220 and a latch 210. The connecting arm 220 is disposed aside the driving shaft 510 and substantially parallel to the driving shaft 510. When the stopping element 300 is in the first state, as shown in FIGS. 3 and 5, the driving shaft 510 contacts the side face of the first arm portion 310, an end of the connecting arm 220 contacts the end face of the second arm portion 320. In addition, an end of the connecting arm 220 opposite to the second arm portion 320 may further connect to an operating device 800. Take the operating device 800 of press-button for example; when the stopping element 300 rotates to the second state as shown in FIGS. 4A and 6A and the end of the second arm portion 320 leaves away from the fastening element 200, the press-button is allowed to be pressed and then pushes the fastening element 200 along the extension direction of the connecting arm 220 to move toward the stopping element 300, i.e. toward the axial portion 390, as shown in FIGS. 4A-4B and 6A-6B. In sum, when the stopping element 300 in the second state releases the fastening element 200, the fastening element 200 can move to the releasing position, as shown in FIGS. 2B, 4B and 6B. In addition, the third arm portion 330 which is angled away from the second arm portion 320 rotates correspondingly while the second arm portion 320 leaves away from the fastening element 200. Depending upon the rotation degree, the included angle between the third arm portion 330 and the second arm portion 320 may face the end of the connecting arm 220 which originally contacts the first arm portion 310. When the press-button is pressed and pushes the fastening element 200 to move in the extension direction toward the stopping element 300, the connecting arm 220 may be confined to the included angle and between the second arm portion 320 and the third arm portion 330. In other words, the fastening element 300 may restrict the fastening element 200 from moving as well as limit a degree of movement of the fastening element 200.

The latch 210 of the fastening element 200 is disposed asides the connecting arm 220. Specifically, one side of the connecting arm 200 may have a supporting structure 250 disposed thereon. The supporting structure 250 is substantially perpendicular to the connecting arm 220. The latch 210 is formed on an end of the supporting structure 250 away from the connecting arm 220. Shape of the latch 210 is not limited; however, the latch 210 preferably has a guiding face. For example, the latch 210 is a short column having the guiding face 215 formed thereon, wherein the guiding face 215 is an inclined plane. The inclining direction of the inclined plane is preferably consistent with the movement direction of the fastening element 200. An elastic member (not shown) may be disposed asides the supporting structure 250 opposite to guiding face 215 and can be pressed such as in the movement direction of the fastening element 200. On the other hand, the trough 110 formed on the housing 100 preferably corresponds to the latch 210. In addition, the latch 210 enters or leaves the trough 110 through the communication of the trough 110 with the interior of the housing 100 so as to interfere with the article to be secured. In detail, when the stopping element 300 is in the second state as shown in FIGS. 4A and 6A while the end of the second arm portion 320 is away from the fastening element 200, the latch 210 is able to enter or leave the trough 110 along with the movement of the fastening element 200, wherein the latch 210 in the securing position stays in a status of being located in the trough 110 as shown in FIG. 2A; in comparison, the latch 210 in the releasing position is away from the trough 110 and accommodated in the housing 100 as shown in FIG. 2B. The moving direction of the latch 210 is parallel to the extension direction of the connecting arm 220. On the contrary, when the stopping element 300 is in the first state as shown in FIGS. 3 and 5, the stopping element 300 restricts the fastening element 200 to be in the securing position.

Preferably, the housing 100 preferably has two troughs 110 formed thereon; meanwhile, the fastening element 200 preferably has two latches 210 which correspond to the troughs 110, respectively. In addition, the troughs 110 are arranged in parallel, wherein a line connecting the two troughs 110 is substantially parallel to the extension direction of the connecting arm 220. In addition to the trough 110, an opening 130 is further formed on the housing 100 to expose the operating device 800.

In addition to the first locking mechanism 400*a*, the present invention further includes a second locking mechanism 400*b*. An unlocking operation of the second locking mechanism 400*b* may release the fastening element 200; a locking operation of the second locking mechanism 400*b* may restrict the fastening element to be in the securing position. The second locking mechanism 400*b* is, as shown in FIG. 4B, preferably a key lock mechanism includes a key-lock lock body 700 and a driving portion 710, wherein the key-lock lock body 700 is a cylinder rotatable in the second locking mechanism 400*b*. The driving portion 710 may be driven by the key-lock lock body and the key; the driving portion 710 may also restrict the fastening element 200 to be in the securing position or release the fastening element 200. The stopping element 300 is preferably movable with the driving portion 710; for example, the driving portion 710 is driven so as to change the state of the stopping element 300.

For example, the stopping element 300 further has a fourth arm portion 340 which extends in a different extension compared to other arm portions. The second locking mechanism 400*b* is disposed at a side of the stopping element 300 having the fourth arm portion 340, wherein the driving portion 710 may radiate from one end of the lock body 700. In one embodiment, the key drives the key-lock lock body 700 and the driving portion 710 to rotate, wherein the driving portion 710 draws a fan-shaped area resulted from its rotation. On the other hand, the fourth arm portion 340 may draw an area resulted from the rotation of the stopping element 300, wherein the area drawn by the fourth arm portion 340 may overlap the fan-shaped area. Take the embodiment shown in FIG. 5 for example; a counterclockwise rotation of the driving portion 710 will push the fourth arm portion 340 to drive the stopping element 300 to have clockwise rotation, so as to make the stopping element 300 leave the first state and release the fastening element 200. The result is as FIG. 6A shows.

The second locking mechanism 400*b* provides the user with other way of unlocking; on the other hand, the second locking mechanism 400*b* allows the lock of the present invention suitable for the Customs for security check.

In other embodiments of the present invention, the lock has sensing system which is electrically connected to the dynamic element 500. Signal transmission and recognition in the sensing system controls the action of the dynamic element 500. Further speaking, the sensing system includes a sensing device and a transmitting device; the signal transmission occurs between the sensing device and the transmitting device. The sensing device may include a sensing apparatus, a reading apparatus, a communicating apparatus or a combination thereof and is provided to acquire (and recognize) signal so as to control the dynamic element 500. For example, the sensing device may include a fingerprint reader, a bar code reader, an ultrared sensor and/or a card reader. The transmitting device may include an emitter (emitting such as radio wave or light), image displaying apparatus, communicating apparatus or a combination thereof. The transmitting device is provided for producing/transmitting signal to the sensing device and controlling the dynamic element 500.

Figure 7:
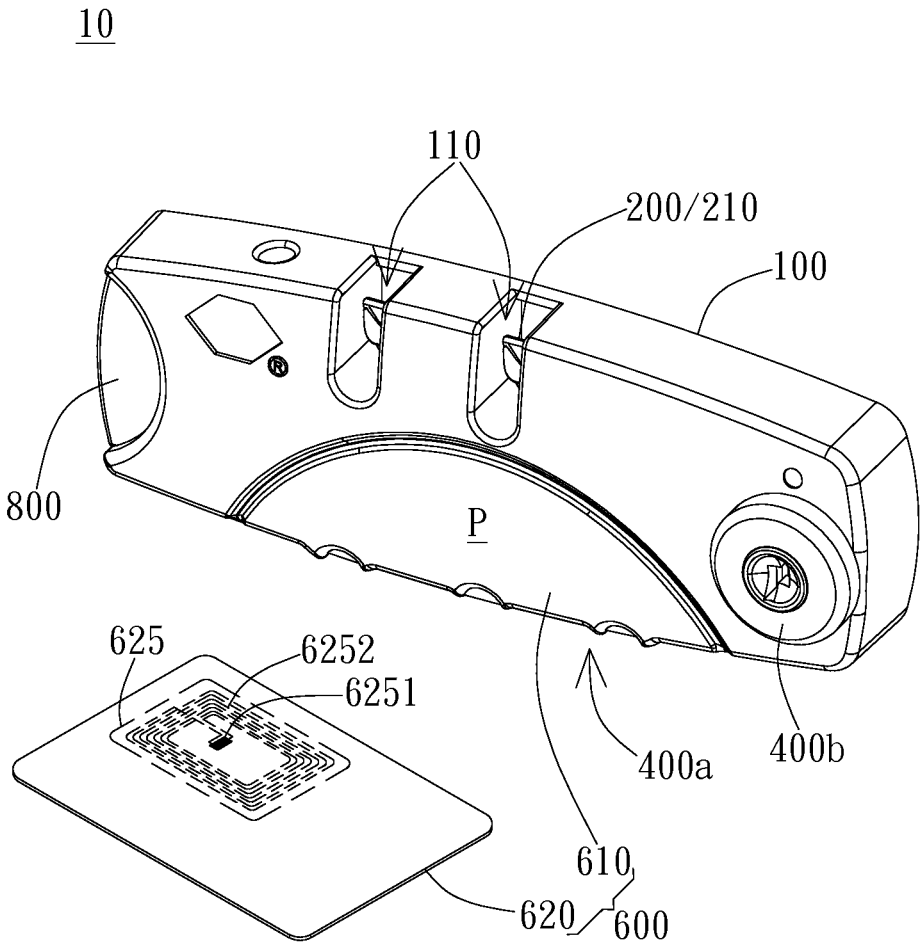
FIG. 7 shows another three-dimensional view of the embodiment of the lock of the present invention.

Preferably, as shown in FIG. 7, the sending system 600 of the embodiment of the present invention is a radio frequency recognition system, wherein the sensing device 610 is a reader; the transmitting device 620 includes a tag 625. The tag 625 carries a code for recognition. In addition, the reader and the tag may be separated from each other while having signal transmission and recognition therebetween within a certain distance/range. In the embodiment shown in FIG. 7, the sensing device 610 (i.e. the reader) is disposed in the lock 10 and produces a sensing area P outsides the housing 100. When the transmitting device 620 or the coded signal thereof enters the sensing area P, the sensing device 610 (i.e. the reader) acquires and recognizes the coded signal so as to activate the dynamic element 500. On the other hand, the transmitting device 620 may be portable device such as the proximity card or cell phone which has the tag. The tag 625 contains a chip 6251 and an antenna 6252. When the transmitting device 620 or the tag 625 enters the sensing area P, the sensing device 610 (i.e. the reader) triggers the tag 625 to transmit the signal of the code. The sensing device 610 will also acquire and recognize the signal of the code and activate the dynamic element 500. In other embodiments, the reader induces the tag to produce electrical energy and activate the dynamic element 500.

Figure 8:
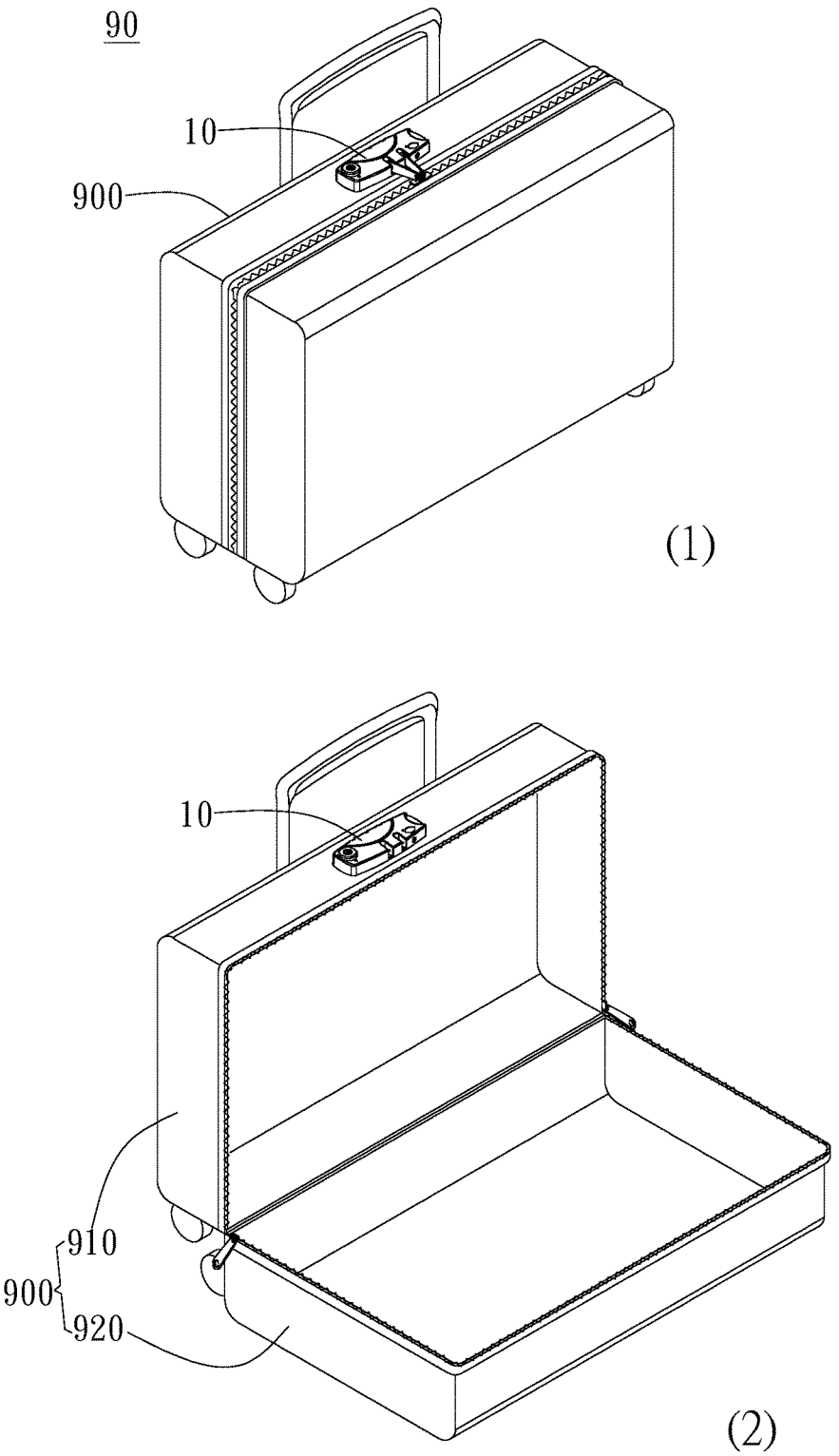
FIG. 8 and FIG. 9 are schematic views of the embodiment of the case of the present invention.

The present invention provides a case for accommodation of articles; the accommodated articles are secured in the case. Preferably, the case is for transportation and is such as a luggage case. As shown in FIG. 8, the case 90 includes a case body 900 and the above mentioned lock 10. The case 90 has a fastener 950 for opening and closing the case body 900; the lock 10 is disposed outsides the case body 900, wherein the fastener 950 corresponds to the trough 110 of the lock 10 and is able to be inserted in the trough 110 so as to interfere with the latch 210. Specifically, the case body 900 may include two housing parts 910 and 920; the first housing part 910 and the second housing part 920 constitute the case body 900 with their openings facing and corresponding to each other. The first housing part 910 and the second housing part 920 are connected to each other at edges of the openings; a zip is disposed around the openings. The first housing part 910 and the second housing part 920 may rotate relative to each other so that the case body 900 is open or closed. When the case body 900 is closed, edges of the openings of the housing parts 910 and 920 are connected to each other, the user can then pull the zip which is disposed substantially along the edges.

Figure 9:
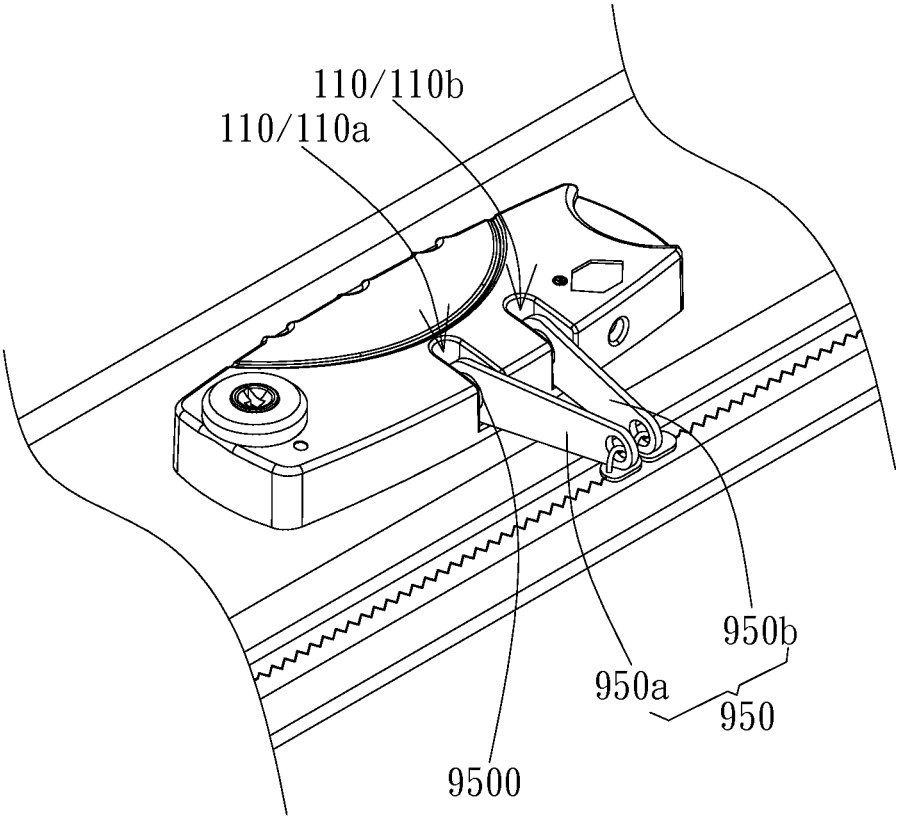

As the embodiment shown in FIG. 9. The fastener 950 includes zip fasteners 950*a* and 950*b*. When the case 900 is zipped up, the zip fasteners 950*a* and 950*b* are close and correspond to a first trough 110*a* and a second trough 110*b*, respectively, as shown in FIG. 9. The zip fastener 950*a* and 950*b* preferably extend into the first trough 110*a* and the second trough 110*b*, respectively. The zip fasteners 950*a* and 950*b* preferably have through holes 9500, respectively.

When the lock 10 is in the unlocked status, the fastening element 200 in the securing position having the latch 210 located in the trough 110 is moveable to the releasing position; meanwhile, the zip fasteners 950*a* and 950*b* may move along the guiding faces 215 of the latch 210 as well as push the latch 210 to temporarily leave away from the securing position so as to be inserted in the trough 110. In addition, when the latch 210 is pushed, the supporting structure 250 moves along with the fastening element 200 and presses the elastic member. The fastening element 200 can move back to the securing position when no force is applied against the elastic member. The fastening element 200 will be back to the securing position when the through hole 9500 of the fastener 950*a* and 950*b* are substantially aligned with the latch 210; the latch 210 can pass though the through hole 9500 and let the zip fasteners 950 and 950*b* stay in the trough 110. When the lock is in the unlocked status, the user may also operate the operating device 800 such as pressing the same so as to drive the fastening element 200 to the releasing position, the latch 210 therefore leaves the trough 110. Accordingly, the zip fastener 950*a* and 950*b* are able to be removed from the trough 110. The released zip fasteners is free for opening the case. When the zip fasteners 950*a* and 950*b* are accommodated in the trough 110, the latch 210 can pass the through hole 9500 and in the securing position make the fastener 950 be confined in the trough 110.

As mentioned above, the activation of the electromagnetic valve lasts for a predetermined period, the driving shaft 510 retracts after the predetermined period until next signal sensing/induction. In this regard, retraction of the driving shaft 510 lets the first arm portion 310 which is originally pushed by the extending driving shaft 510 be able to rotate back. Accordingly, the second arm portion 320 rotates along with the stopping element 300, back to contact the fastening element 200 and restrict the fastening element 200 to be in the securing position. The lock 10 is therefore locked until next signal sensing/induction to activate the dynamic element 500.

As mentioned above, the present simplifies unlocking and locking operations. In addition, the lock of the present invention is electrical lock. Accordingly, in comparison to the completely mechanical lock, the lock of the present invention is not only smaller and lighter but also suitable for transport facilities due to the tolerance to impact.

Although the preferred embodiments of present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A lock, including:

a housing;

a fastening element movable and selectively located at a securing position and a releasing position, wherein the fastening element includes a connecting arm;

a stopping element having a first state and a second state; wherein the stopping element in the first state restricts the fastening element to be in the securing position, the stopping element in the second state releases the fastening element, wherein the stopping element includes:

an axial portion;

a first arm portion;

a second arm portion angled away from the first arm portion; and a third arm portion angled away from the second arm portion, wherein the connecting arm is able to be confined between the second arm portion and the third arm portion;

wherein the first arm portion, the second arm portion, and the third arm portion radiate from the axial portion;

a first locking mechanism, comprising:

a dynamic element moving with the stopping element and driving the stopping element to change between the first state and the second state; and a sensing device electrically connected to the dynamic element, the sensing device sensing a signal and controlling an action of the dynamic element; and a second locking mechanism comprising a key-lock lock body disposed in the housing;

wherein the fastening element, the stopping element and the dynamic element are disposed in the housing, the fastening element moves relative to the housing and is selectively located at the securing position and the releasing position.

2. The lock of claim 1, wherein the signal includes electromagnetic wave, image signal or biological characteristic signal.

3. The lock of claim 1, further including a power source connected to the sensing device.

4. The lock of claim 1, wherein the sensing device produces a sensing area outsides the housing, the signal enters the sensing area, the sensing device receives the signal and controls the action of the dynamic element.

5. The lock of claim 1, wherein the sensing device is a radio frequency identification element.

6. The lock of claim 1, wherein the dynamic element is an electromagnetic valve; the electromagnetic valve has a driving shaft, wherein the sensing device controls the driving shaft to extend or retract.

7. The lock of claim 1, wherein the dynamic element has a driving shaft, the driving shaft extends and pushes the first arm portion to drive the stopping element to rotate; the second arm portion in the first state contacts the fastening element and restricts the fastening element to be in the securing position; when the driving shaft drives the stopping element to rotate to the second state, the second arm portion releases the fastening element.

8. The lock of claim 1, wherein the fastening element comprises a latch disposed asides the connecting arm; one end of the connecting arm contacts the stopping element in the first state; the stopping element in the second state releases the fastening element, and the fastening element moves along the extension direction of the connecting arm to locate at the releasing position.

9. The lock of claim 8, wherein the housing further has a trough formed thereon and communicating with an interior of the housing, wherein the latch is capable of entering or leaving the trough, the latch stays in the trough when the fastening element is in the securing position.

10. The lock of claim 8 further including an operating device driving the fastening element to move.

11. The lock of claim 10, wherein the operating device is a press-button partially exposed and protruding out of the housing, wherein the operating device is disposed at one end of the connecting arm opposite to the stopping element, the operating device is pressed and pushes the fastening element in the extension direction of the connecting arm.

12. The lock of claim 1, wherein the second locking mechanism further comprises a driving portion, the driving portion is driven by a key and the key-lock lock body to change the state of the stopping element.

13. The lock of claim 1, wherein the stopping element further includes a fourth arm portion extending in a different extension compared to the first arm portion, the second arm portion, and the third arm portion; wherein the first arm portion, the second arm portion, the third arm portion, and the fourth arm portion radiate from the axial portion.

14. A lock, including:

a housing;

a fastening element, movable and selectively located at a securing position and a releasing position, wherein the fastening element includes a connecting arm;

a stopping element having a first state and a second state; wherein the stopping element in the first state restricts the fastening element to being in the securing position, the stopping element in the second state releases the fastening element, wherein the stopping element includes:

an axial portion;

a first arm portion;

a second arm portion angled away from the first arm portion; and a third arm portion angled away from the second arm portion, wherein the connecting arm is able to be confined between the second arm portion and the third arm portion;

wherein the first arm portion, the second arm portion, and the third arm portion radiate from the axial portion;

a first locking mechanism, comprising:

a dynamic element moving with the stopping element and driving the stopping element to change between the first state and the second state; and a sensing system electrically connected to the dynamic element, comprising a sensing device and a transmitting device, wherein signal transmission and recognition between the sensing device and the transmitting device controls the action of the dynamic element; and a second locking mechanism comprising a key-lock lock body and a driving portion disposed in the housing; wherein the driving portion is driven by a key and the key-lock lock body to change the state of the stopping element;

wherein the fastening element, the stopping element and the dynamic element are disposed in the housing, an outcome of the signal transmission and recognition is to activate the dynamic element, the fastening element moves relative to the housing and is selectively located at the securing position and the releasing position.

15. The lock of claim 14, wherein the sensing system is a radio frequency identification system including a reader and a tag, wherein the tag carries a code for recognition.

16. The lock of claim 14, wherein the stopping element further includes a fourth arm portion extending in a different extension compared to the first arm portion, the second arm portion, and the third arm portion; wherein the first arm portion, the second arm portion, the third arm portion, and the fourth arm portion radiate from the axial portion.

17. A case, including:

a case body having a fastener for opening and closing the case body; and a lock as recited in claim 1 disposed outside the case body and on a body wall, wherein the housing has a trough formed thereon, the trough communicates with an interior of the housing and corresponds to the fastener; wherein the fastening element comprises a latch capable of entering or leaving the trough, the latch stays in the trough when the fastening element is in the securing position.

18. The case of claim 17, wherein the fastener has a through hole and is accommodated in the trough, the latch in the securing position passes through the through hole and retains the fastener in the trough.

19. The case of claim 17, wherein the latch has a guiding face; when the stopping element is in the second state, the fastener is capable of moving along the guiding face, pushes the latch to temporarily leave the securing position and is inserted in the trough; the latch goes back to the securing position and is retained in the trough.

20. The case of claim 17, wherein the stopping element further includes a fourth arm portion extending in a different extension compared to the first arm portion, the second arm portion, and the third arm portion; wherein the first arm portion, the second arm portion, the third arm portion, and the fourth arm portion radiate from the axial portion.

* * * * *